United States Patent [19]

Keeffe et al.

[11] Patent Number: 4,625,141

[45] Date of Patent: Nov. 25, 1986

[54] LOW WATTAGE METAL HALIDE DISCHARGE LAMP ELECTRICALLY BIASED TO REDUCE SODIUM LOSS

[75] Inventors: William M. Keeffe, Rockport; Zeya K. Krasko, Danvers, both of Mass.; Robert J. Karlotski, Weare, N.H.

[73] Assignee: GTE Products Corporation, Stamford, Conn.

[21] Appl. No.: 665,471

[22] Filed: Oct. 29, 1984

[51] Int. Cl.[4] ..... H01J 61/04; H01J 61/18; H01J 61/34

[52] U.S. Cl. ..... 313/25; 313/634; 313/638

[58] Field of Search ..... 313/25, 634, 489, 638, 313/642

[56] References Cited

U.S. PATENT DOCUMENTS 4,499,396 2/1985 Fohl et al. ..... 313/634 X

FOREIGN PATENT DOCUMENTS 101519 2/1984 European Pat. Off. .

852783 11/1960 United Kingdom ..... 313/25

*Primary Examiner*—David K. Moore

*Assistant Examiner*—K. Wieder

*Attorney, Agent, or Firm*—Jose' W. Jimenez; Thomas H. Buffton

[57] ABSTRACT

A low wattage metal halide discharge lamp includes an evacuated envelope wherein is disposed a heat reducing member having an arc tube therein. The heat reducing member and the arc tube have a metal band and outer strap member adjacent one another and adjacent an electrode with the metal band, strap member and electrode all electrically connected to an electrical lead of one polarity whereby sodium losses from the arc tube are reduced.

13 Claims, 2 Drawing Figures

LOW WATTAGE METAL HALIDE DISCHARGE LAMP ELECTRICALLY BIASED TO REDUCE SODIUM LOSS

TECHNICAL FIELD

This invention relates to low wattage metal halide discharge lamps and more particularly to low wattage metal halide discharge lamps configured and electrically connected to provide a reduced rate of sodium loss.

BACKGROUND ART

Generally, metal halide discharge lamps are of the intermediate or relatively high wattage variety such as about 175 to 1500 watts for example. Also, it is known that the efficacy of the lumen output to input power decreases as the wattage of the lamp decreases. Thus, it has been generally presupposed that at lower wattages, wattages of 100 watts or less, metal halide discharge lamps would be entirely unsatisfactory in so far as efficacy is concerned.

Also, it has been a common practice in the intermediate and relatively high wattage lamps to provide an inert fill gas in the outer envelope in order to prevent oxidation of metal parts of the arc tube mount. Another advantage of an inert gas fill in an outer envelope is a high breakdown voltage which prevents arcing between metal parts of the arc tube mount. However, an undesired heat loss due to convection currents of the inert gas in the outer envelope reduces the lamp efficacy significantly.

One known attempt to reduce these undesired heat losses due to convection currents is disclosed in U.S. Pat. No. 4,499,396 to Fohl et al., issued on Feb. 12, 1985 and assigned to the Assignee of the present application. Therein, a quartz envelope is disposed within the gas filled outer envelope of a metal halide discharge lamp in an effort to reduce heat losses due to convection currents.

Another attempt to reduce undesired heat loss due to convection currents is set forth in U.S. Pat. No. 4,281,274. Therein, a glass cylinder surrounds an arc tube within an outer glass envelope. The outer glass envelope includes one or more lamp filaments and is filled with a gas under pressure. Thus, a glass cylinder and a gas filled outer envelope are employed to reduce the heat loss due to convection currents. However, structures having gas filled envelopes and accompanying convection currents leave something to be desired in reduction of heat loss in so far as relatively high pressure lamps are concerned.

OBJECTS AND SUMMARY OF THE INVENTION

An object of the present invention is to overcome the difficulties of the prior art. Another object of the invention is to provide a low wattage metal halide discharge lamp having reduced sodium losses. Still another object of the invention is to provide an improved low wattage metal halide discharge lamp. A further object of the invention is to reduce thermal differences in a low wattage metal halide discharge lamp.

These and other objects, advantages and capabilities are achieved in one aspect of the invention by a low wattage metal halide discharge lamp having a chemically-filled arc tube with electrodes at opposite ends and an outer strap at one end, a heat reducing member with a metal band at one end and in surrounding relationship thereto, an evacuated outer envelope having a pair of leads passing therethrough and a means for positioning the outer strap of the arc tube and metal band of the heat reducing member adjacent one another and for connecting the electrode, adjacent outer strap and metal band to one of the pair of leads and the other electrode to the other lead of the outer envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
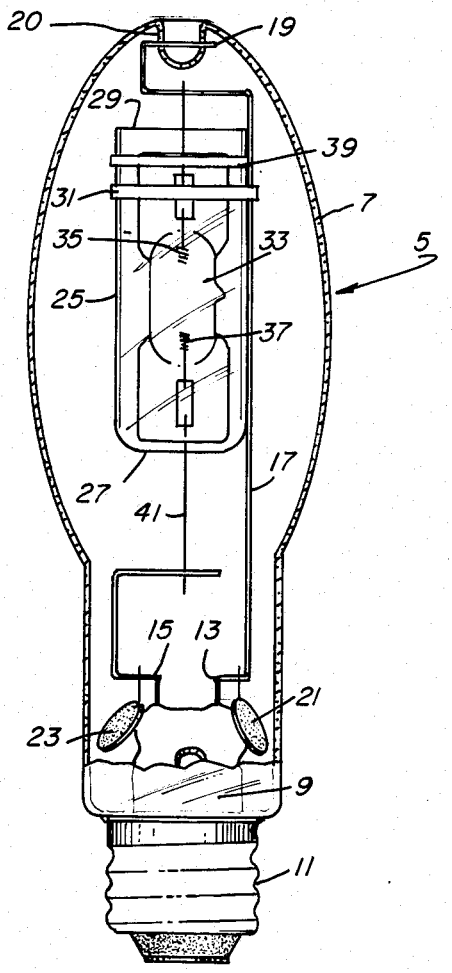
FIG. 1 is a cross-sectional view of one embodiment of a low wattage metal halide discharge lamp of the invention.

Referring to the drawings, FIG. 1 illustrates a low wattage metal halide discharge lamp 5 which, importantly, includes an evacuated outer envelope 7. This evacuated outer envelope 7 is hermetically sealed to a glass stem member 9. An external base 11, formed for easy connection to an electrical source, is affixed to the hermetically sealed stem member 9 and outer envelope 7. A pair of electrical conductors 13 and 15 are sealed into and pass through the stem member 9 and electrically connected to the base 11 external of the outer envelope 7 to provide access for energization of the discharge lamp 5.

Within the evacuated outer envelope 7 and affixed to one of the electrical conductors 13 is an electrically conductive support member 17. This electrically conductive support member 17 extends along an axis substantially parallel to the longitudinal axis of the discharge lamp 5 and includes a circular configuration 19 at or near the upper most portion 20 of the evacuated outer envelope 7. This circular configuration 19 in conjunction with the upper most portion 20 of the outer envelope 7 serves to maintain the support member 17 in proper alignment and resistant to deformation due to external shock to the discharge lamp 5.

Also disposed within the evacuated envelope 7 and affixed to the electrical conductors 13 and 15 therein are a pair of barium getters 21 and 23 respectively. These barium getters 21 and 23 are positioned at one end of the outer envelope 7 and adjacent to the glass stem member 9 and external base 11. As is well known, these barium getters 21 and 23 are important in any structure wherein an evacuated or vacuum is desired such as the above-described evacuated outer envelope 7.

Disposed within the evacuated envelope 7 is a heat reducing member 25 in the form of a quartz sleeve. This heat reducing member 25 includes a domed portion 27, which is positioned closest to the getters 21 and 23 and base 11, and an open-ended portion 29 which is furthest from and faces away from the getters 21 and 23 and base 11. A metal band 31 surrounds and is affixed to the heat reducing member 25 and is electrically and mechanically connected to the support member 17.

Within the heat reducing means 25 is an arc tube 33. This arc tube 33 has a chemical fill including a sodium halide and in a preferred embodiment includes iodides of sodium and scandium of a ratio in the range of about 20:1 to 28:1. The arc tube 33 also includes an electrode, 35 and 37 at each end thereof with a metal strap member 39 affixed to the outer surface thereof and electrically and mechanically connected to the support member 17. Moreover, the electrode 35 is mechanically and electrically connected to the support member 17 while the other electrode 37 is affixed to an electrical conductor 41 which passes through the dome portion 27 of the heat reducing member 25 and is electrically and mechanically connected to the other electrical connector 15. Importantly, the metal strap member 39 is immediately adjacent the metal band 31 affixed to the heat reducing member 25 and the one electrode 35 of the arc tube 33. Moreover, the strap member 39, metal band 31 and one electrode 35 are all electrically connected to the support member 17 and to the one electrical conductor 13.

Figure 2:
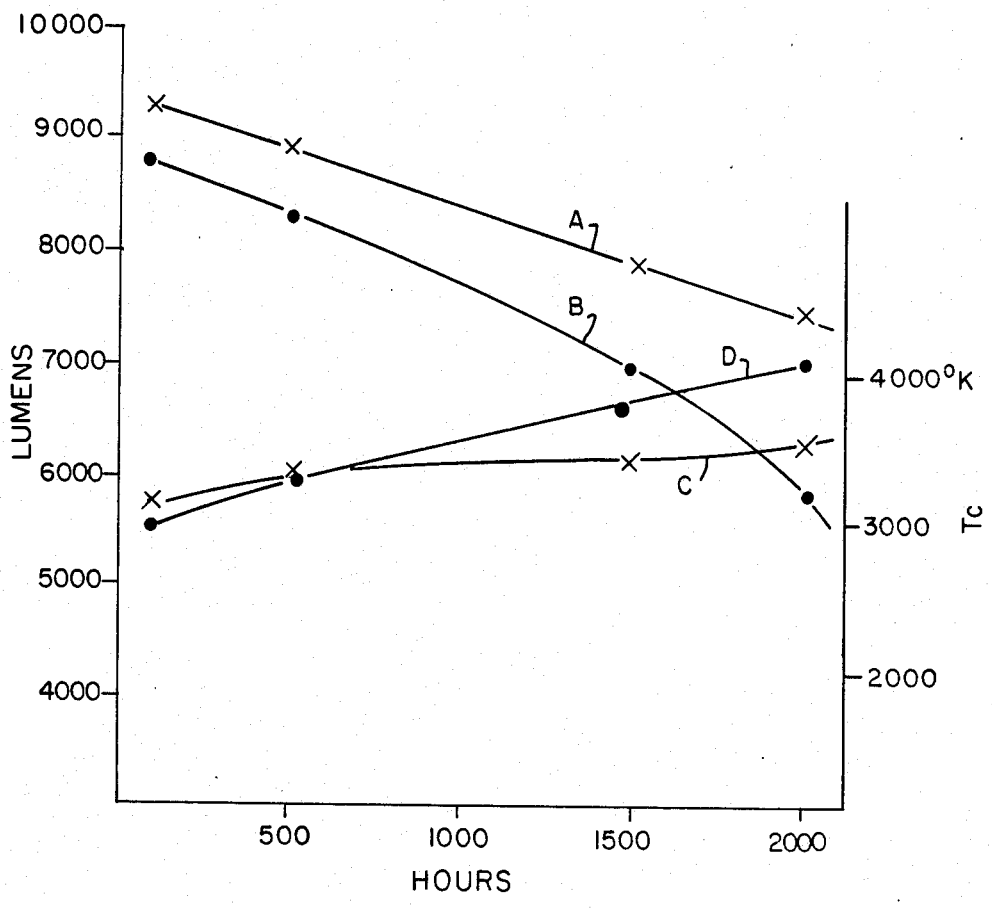
FIG. 2 is a chart comparing lumen and color temperature maintenance during operational use of a metal halide lamp prior to and including the present invention.

Although the low wattage metal halide discharge lamps are preferably in the range of about 40 to 150, the comparison chart of FIG. 2 illustrates the variations in maintenance of color temperature, voltage and lumen output of a 100-watt metal halide lamp. As can readily be seen, lumen maintenance for a 100-watt metal halide discharge lamp wherein the strap member 39 is adjacent the metal band 31 surrounding an electrode 35 and all are connected to one electrical conductor 13, Curve A, is at least about 80% and in this example about 81% after 2000-hours of operational use as compared with about 69%, Curve B, when the electrical connection and positional locations differ from the above-mentioned configuration.

Similarly, it can readily be seen that the color temperature rise after 2000-hours of operational use of a discharge lamp having the strap member 39, metal band 31 and electrode 35 adjacent one another and electrically connected to the same electrical conductor 13 is not more than about 500° K. and specifically only about 411° K. (Curve C). In contrast, a discharge lamp operated for 2000-hours without having the above-mentioned polarity and positional location of parts had an undesired color temperature rise (Curve D) in the range of about 1027° K. Moreover, the tests provide a voltage rise of not more than about 8.0-volts and an actual test result of 5.8-volts for the above-described positionally located and electrically connected lamp as compared with an undesired rise of about 24.0-volts when the strap member 39, metal band 31 and electrode 35 were not connected and positioned as previously described.

Accordingly, it has been found that a metal halide discharge lamp employing a heat reducing means with an affixed metal strap connected to an electrical lead of a given polarity, an arc tube with a metal band affixed and positioned adjacent the metal strap and connected to the same electrical lead and an electrode of the arc tube adjacent the metal strap and metal band and connected to the same electrical conductor provide an enhanced capability in a discharge lamp. Moreover, it is believed that the enhanced electrical characteristics are clear indications of a reduction in loss of sodium from the arc tube during operational life of the discharge lamp.

While there has been shown and described what is at present considered the preferred emodiments of the invention, it will be obvious to those skilled in the art that various changes and modifications may be made therein without departing from the invention as defined by the appended claims.

We claim:

1. A metal halide discharge lamp comprising:

an arc tube having a chemical fill including a sodium halide, an electrode at each end thereof and an outer strap member affixed thereto and adjacent at least one of said electrodes;

a heat reducing member surrounding said arc tube and having a metal band surrounding and affixed adjacent one end thereof;

an evacuated outer envelope surrounding said heat reducing member, said evacuated outer envelope having a pair of electrical conductors sealed therein and passing therethrough; and means for reducing sodium loss from said arc tube that includes positioning said outer strap member of said arc tube adjacent said metal band of said heat reducing member and electrically coupling said strap member, said metal band and said electrode adjacent said outer strap member to one of said pair of electrical conductors and coupling the other one of said electrodes of said arc tube to the other one of said pair of electrical conductors.

2. The metal halide discharge lamp of claim 1 wherein said heat reducing member is in the form of a domed quartz sleeve.

3. The metal halide discharge lamp of claim 2 wherein said domed quartz sleeve has an open end and said metal band is positioned adjacent said open end.

4. The metal halide discharge lamp of claim 1 wherein said lamp is of a wattage in the range of about 40 to 150-watts.

5. The metal halide discharge lamp of claim 1 wherein said chemical fill includes sodium and scandium iodides in a ratio of about 20:1 to 28:1.

6. The metal halide discharge lamp of claim 1 wherein said lamp is a 100-watt lamp and said lamp has a lumen maintenance of at least 80% after 2000 operational hours.

7. The metal halide discharge lamp of claim 1 wherein said lamp is a 100-watt lamp and has a rise in color temperature of less than about 500° K. after 2000 operational hours.

8. The metal halide discharge lamp of claim 1 wherein said lamp is a 100-watt lamp and experiences a voltage rise of not more than about 8.0-volts after 2000 operational hours.

9. The metal halide discharge lamp of claim 1 wherein said lamp is a 100-watt lamp and experiences a rise in color temperature of not more than about 500° K., a rise in voltage of not more than about 8.0-volts and a lumen maintenance of about 80% after 2000 hours of operation.

10. A metal halide discharge lamp with a reduced rate of sodium loss comprising:

an evacuated glass envelope;

a pair of electrically conductive leads sealed into and passing through said glass envelope;

a domed quartz sleeve disposed within said glass envelope, said sleeve having an open end and an outer metal band surrounding and affixed thereto;

an arc tube disposed within said domed quartz sleeve, said arc tube having an electrode at each end and an outer strap of said electrodes electrically coupled to one of said pair of electrically conductive leads;

a chemical fill including iodides of sodium and scandium within said arc tube;

and means for reducing sodium loss from said arc tube that includes electrically coupling said one electrode, said outer strap member of said arc tube and said outer metal band of said quartz sleeve to the other one of said pair of electrically conductive leads.

11. The metal halide discharge lamp of claim 10 wherein said lamp is of a wattage in the range of about 40 to 150-watts.

12. The metal halide discharge lamp of claim 10 wherein said iodides of sodium and scandium are in the range of about 20:1 to 28:1.

13. The metal halide discharge lamp of claim 10 wherein said lamp is a 100-watt lamp and has a color temperature rise in the range not more than about 500° K. after 2000 l operational hours.

* * * * *